United States Patent [19]

Ahmann

[11] Patent Number: 4,642,450

[45] Date of Patent: Feb. 10, 1987

[54] PUNCHING STYLUS FOR HANDICAPPED USERS

[75] Inventor: John E. Ahmann, Napa, Calif.

[73] Assignee: Election Supplies Limited, Napa, Calif.

[21] Appl. No.: 861,425

[22] Filed: May 9, 1986

[51] Int. Cl.[4] ..... G07C 13/00

[52] U.S. Cl. ..... 235/50 R; 235/89 R; 235/1 R

[58] Field of Search ..... 235/1 R, 50 R, 50 A, 235/51, 89 R

[56] References Cited

U.S. PATENT DOCUMENTS 3,201,038 8/1965 Harris ..... 235/50 R
3,240,409 3/1966 Harris ..... 235/50 R X
4,258,249 3/1981 Ahmann ..... 235/50 R
4,485,298 11/1984 Stephens et al. ..... 235/50 R

*Primary Examiner*—Benjamin R. Fuller
*Attorney, Agent, or Firm*—Owen, Wickersham & Erickson

[57] ABSTRACT

A punch-out stylus for use with a tabulating device particularly for handicapped persons has a generally elongated body section with a rigid rod member extending axially from one end therefrom and having a tip designed for removing chad from a pre-scored card. An enlarged body portion is attached to the other end of the elongated body section and has an indentation along one side adapted to receive the thumb of the stylus user as the enlarged body portion is gripped.

4 Claims, 3 Drawing Figures

PUNCHING STYLUS FOR HANDICAPPED USERS

This invention relates to an improved hand-held stylus for use with card punching data recording devices, and more particularly to a stylus that can be more easily gripped by relatively weak or handicapped persons.

BACKGROUND OF THE INVENTION

For use with such data recording devices commonly used as voting devices, a tabulating card is provided having individually scored areas that can be selectively removed in the form of chips or punch outs called "chad". The data recording device generally includes a punch board or die comprised of parallel spaced apart strips of thin material adapted to provide a firm support for the card. Spaces between the parallel strips allow for the removal of punched out chad. A template is normally provided over the board of parallel strips and has a plurality of holes in rows aligned with the strips. The holes serve to guide a voter's punch or stylus which is punched through selected scored area of a card that are registered directly above the template holes by the device.

Heretofore, the stylus used for the card punch-out voting devices described comprised a slender cylindrical rod with a blunt hardened tip extending from an enlarged cylindrical handle of flexible material. Such a stylus is shown in my U.S. Pat. No. 4,258,249. A chain attached to the handle normally is used to retain the stylus with the voting device. On other stylus devices previously devised, a spherical member of molded rubber material was attached to a rigid handle to enable the stylus to be gripped more firmly, particularly by handicapped persons. However, problems arose with such stylus devices because, for some persons, the full spherical member was difficult to grip firmly and with a person's hand on it, the target hole for the stylus became difficult to see. Also, in some instances, the spherical member was gripped so that an inadvertent side load by the user caused the cylindrical handle to break along a through-hole provided for the end of the retaining chain. During periods where voting procedures are taking place within a relatively short time period, any breakage or malfunction of the voting equipment, however small, created a serious problem.

It is therefore a general object of the present invention to provide an improved stylus for handicapped persons that overcomes the aforesaid problems.

More specifically, an object of the invention is to provide a stylus for use with punch-out type voting devices which has a handle member that will enable a person to grip the stylus firm, with comfort and always with an orientation which holds the stylus in the strongest position to resist side loads that might otherwise cause the handle to break.

Another object of the invention is to provide a voting stylus for handicapped persons that will provide better vision for the stylus target when it is gripped.

Still another object of the invention is to provide an improved stylus for handicapped persons which is particularly well adapted for ease and economy of manufacture.

SUMMARY OF THE INVENTION

In accordance with the invention, a stylus device, particularly for handicapped persons, is provided having a standard elongated and slender rod member with a blunt outer end adapted to engage and push out a selected perforated area on a paper tabulating cords when used with a voting device. The inner end of the stylus rod is fixed to a cylindrical handle portion having a transverse hole for retaining the end of a chain. Integral with this cylindrical portion is an enlarged hand grip extension which, according to the invention, is shaped with a transverse indentation so that a user's thumb is normally positioned within the indentation. When so held, the cylindrical handle portion of the stylus device is oriented so that minimal stress will occur at that weakened area on the cylindrical handle portion that includes the through hole for the chain. Thus, the present invention provides a stylus device that is easier to grip and use, particularly for a handicapped person, and also one that is less subject to breakage and thus more durable and reliable.

Other objects, advantages and features of the invention will become apparent from the following detailed description of one embodiment thereof, presented in conjunction with the accompanying drawing.

DETAILED DESCRIPTION OF EMBODIMENT

Figure 1:
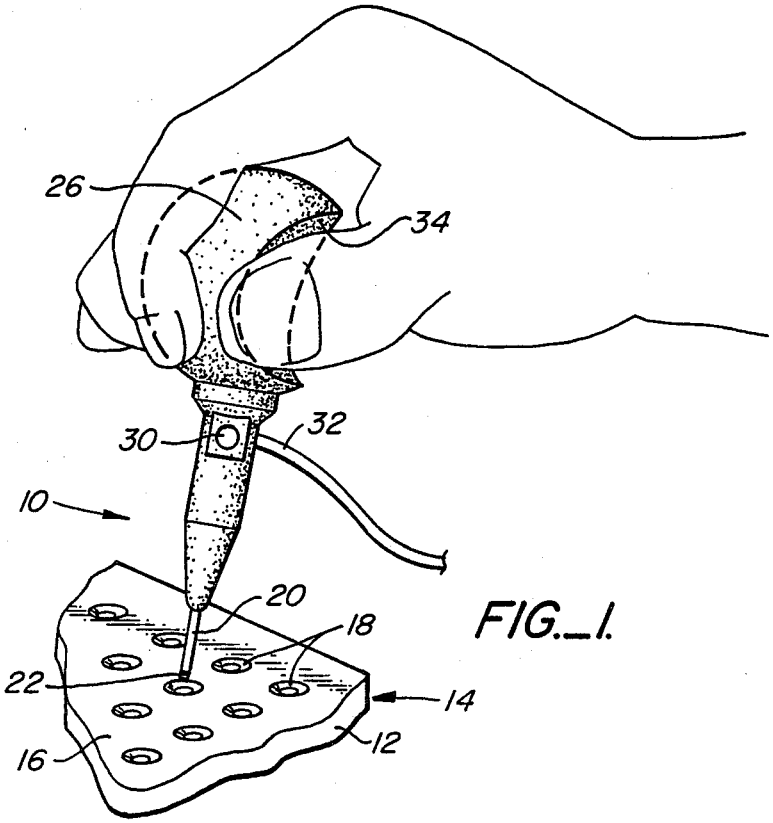
FIG. 1 is a view in perspective showing a punch-out stylus embodying principles of the present invention, as it appears when in use.

With reference to the drawing, FIG. 1 shows a stylus 10 embodying principles of the present invention as it appears when used typically for punching out perforated portions of a tabulating card 12 that is held within a data registering or voting device 14. The latter includes a plate or template 16 which overlays the card and has holes 18 which register with the perforated portions of the card. When the desired perforated portion is selected by a user/voter, a frontal rod member 20 of the stylus having a blunt end 22 is inserted through a hole 18 and through the perforated card portion directly below to remove a card chip.

When used by elderly or handicapped persons, the stylus must be gripped firmly in order to be properly guided through a hole 18 in the plate 16 in a fairly straight manner in order not to cause excessive stress on the rod member 20.

Figure 2:
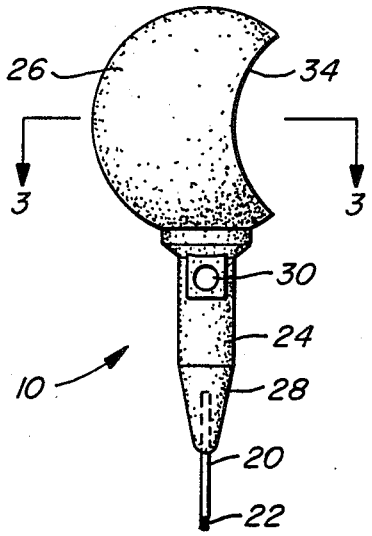
FIG. 2 is a view in elevation of the punch-out stylus of FIG. 1.
Figure 3:
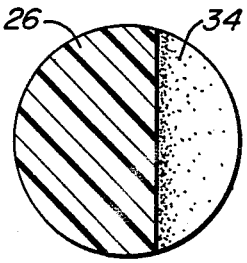
FIG. 3 is a view in section taken along the line 3—3 of FIG. 2.

As shown in FIG. 1 and in greater detail in FIGS. 2 and 3, the stylus 10 comprises an elongated body section 24 with an enlarged end portion 26 which are preferably molded as an integral unit from a suitable, flexible but durable material such as SBR (silicone rubber having a durometer of around 75–80. The elongated body section which is generally cylindrical, supports the rod member 20 whose inner end is embedded within a tapered end portion 28 of the body section. As described in my U.S. Pat. No. 4,258,249, the rod member itself is preferably made from heat treated stainless steel and is knurled or serrated near its blunt tip 22.

Near the other end of the elongated body section 24 is provided a transverse hole 30 for retaining one end of a bead chain 32 which is attached by its other end to the data registering device 14 by suitable means, not shown. The hole 30 must be sufficiently large to retain the chain, and therefore it creates an inherent area of structural vulnerability that can fail if excessive side loads are supplied to the stylus. However, the enlarged end portion 26, in accordance with the invention, serves to avoid such side loads while also making it easier for a person, particularly one that is handicapped, to properly grip and use the stylus.

In the embodiment shown, the enlarged end portion 26 of the stylus 10 has a generally spherical shape but with a sizable groove-like indentation 34 on one side thereof. Actually, the indentation 34 is preferably a cylindrical surface formed by the generation of a cylinder whose diameter is generally the same as the sphere of the enlarged portion 26 and whose central axis is outside the sphere and extends perpendicular to a plane containing the axis of the elongated body section. Also, the axis of the indentation 34 is preferably generally parallel to the axis of the transverse hole 30 extending through the body section 26.

When the stylus 10 is used, as shown in FIG. 1, the user person grips the spherical end portion 26 with his or her fingers around it and with the thumb comfortably with the indentation 34. This enables the person, even though handicapped and having minimal finger movement strength of dexterity, to adequately grip and control the stylus. Moreover, the indentation 34 causes the user to hold the stylus in such a position that the target hole for the stylus is easily seen and the weakened area of the body 26 with the transverse hole 30 is always in the best position to resist side or bending loads that might otherwise break the stylus at that weakened area.

In making the stylus 10, the body section 24 and the enlarged end portion 26 with its side groove 34 are molded as an integral unit using the flexible silicone rubber material, as previously described. The rod 20 is also inserted and embedded in the body section 24 during the molding process.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A punch-out stylus for use with a tabulating device having an upper plate with holes adapted to register with scored punch-out area on a tabulation sheet placed under the plate, said stylus comprising:

a generally elongated body section having inner and outer ends and a transverse hole extended diametrically therethrough adapted for retaining one end of a flexible chain;

a rigid rod member axially aligned with and having one end portion embedded within said inner end of said elongated body section and another end portion extending beyond said elongated body section, with a tip portion adapted for insertion into any selected hole of said upper plate; and an enlarged body portion attached to said outer end of said elongated body section, said enlarged body section having an indentation along one side adapted to receive the thumb of said user as said enlarged body portion is gripped.

2. The stylus device as described in claim 1 wherein said enlarged body portion has a generally spherical shape and said indentation forms a portion of a cylindrical wall extending through one side of said enlarged body portion and generally perpendicular to a plane containing the longitudinal axis of said elongated body section.

3. The stylus device as described in claim 1 wherein said elongated body section portion and said enlarged body portion are formed as an integral unit from a flexible moldable material.

4. The stylus device as described in claim 2 wherein the longitudinal axis of said cylindrical wall of said indentation is generally parallel with the axis of said transverse hole in said elongated body section, whereby minimal stress can be applied to said hole when a user's thumb is within said indentation during use of the stylus.

* * * * *